United States Patent [19]

Caplan et al.

[11] 4,218,900

[45] Aug. 26, 1980

[54] CARPET CLEANING AND DYEING APPARATUS

[76] Inventors: Lew Caplan, 310 NW. 71st St.; Robert W. Kemper, 10 NW. 71st St., both of Miami, Fla. 33150

[21] Appl. No.: 64,092

[22] Filed: Aug. 6, 1979

[51] Int. Cl.[3] ..... D06B 1/08

[52] U.S. Cl. ..... 68/205 R; 15/322

[58] Field of Search ..... 15/321, 322; 68/205 R, 68/222, 5 B, 213, 214

[56] References Cited

U.S. PATENT DOCUMENTS

| | | | |
|---|---|---|---|
| 3,065,489 | 11/1962 | Wright | 15/321 X |
| 3,365,762 | 12/1967 | Cavell et al. | 15/321 |
| 3,562,844 | 2/1971 | Thompson et al. | 15/321 X |
| 4,167,799 | 9/1979 | Webb | 15/322 X |

*Primary Examiner*—Philip R. Coe
*Attorney, Agent, or Firm*—Ernest H. Schmidt

[57] ABSTRACT

An elongated tubular handle and support member connectable at its upper end with a vacuum hose and at its lower end with a vacuum head having a perpendicularly extending, elongated suction opening and including a pair of spray nozzles fixed with respect to the vacuum head and adapted to spray, respectively and selectively, either carpet cleaning fluid or carpet dyeing fluid behind the vacuum head, supports along the length thereof an open-topped container for removably receiving a liquid dye container. The tubular handle and support member also has attached thereto a control valve assembly for directing fluid under pressure to either of said spray nozzles, selectively, from a single remote source. The means supplying pressurized fluid to one of the spray nozzles includes a flexible conduit series-connected in which is a venturi member having a venturi orifice communicating through a control valve with the dye container for withdrawing dye into the flow path of the pressurized fluid supply to the dye spraying nozzle.

7 Claims, 5 Drawing Figures

CARPET CLEANING AND DYEING APPARATUS

This invention relates to carpet cleaning and dyeing apparatus, and is directed particularly to such apparatus wherein a liquid spray cleaning or dyeing solution deposited on a rug or carpeting to be treated is withdrawn through an elongated vacuum opening in a vacuum head reciprocated along the rug or carpeting during the preselected cleaning or dyeing operation. Such known appartus comprises, generally, an elongated handle carrying a vacuum head at its lower end, which can be manipulated as one would an ordinary carpet sweeper or vacuum cleaner. In addition to the vacuuming feature, wherein vacuum is usually supplied through a flexible hose from a remote source connected in communication with the upper end of the tubular handle, a pair of fluid discharge nozzles are provided for spraying directly behind the vacuum head. Pressurized fluid from a remote source, also supplied through a flexible hose, connects through suitable valve control means with one of the spray nozzles for cleaning. Heretofore, for carpet or rug dyeing, dye solution was alternatively supplied from a remote source through a second flexible hose to the other spray nozzle. It is accordingly the principle object of this invention to provide a novel and improved cleaning and dyeing apparatus wherein the dyeing means is fully self-contained and supported by the elongated handle, for simplicity of operation, and to eliminate the usual dye fluid supply hose leading from a remote source.

A more particular object of this invention is to provide valve means supported by the elongated handle for selectively dividing the pressurized fluid supplied through the flexible hose into two flow paths, one of which communicates with the carpet cleaning spray nozzle, and the other which communicates with the carpet dyeing spray nozzle, and wherein the flow path leading to the carpet dyeing nozzle comprises conduit means series connected in which is a venturi member having a venturi oriface communicating through a length of flexible tubing with a replaceable dye container receivable in an open ended container supported by the tubular handle.

It is another object of the invention to provide a carpet cleaning and dyeing apparatus of the character described wherein the dye container is in the form of a flexible plastic bag with removable connection thereto being made by use of a hollow needle inserted therein.

Another object of the invention is to provide a carpet cleaning and dyeing apparatus of the character described including a metering valve in the flexible conduit leading to the dye container for fine manual adjustment of dye being withdrawn from the dye container through the venturi oriface for mixture with the pressurized fluid being supplied to the dye spraying nozzle.

Yet another object of the invention is to provide a carpet cleaning and dyeing apparatus of the above nature which will be simple in construction, compact, light in weight, easy to adjust and control in changing between cleaning and dyeing operations, and dependable and durable in use.

Other objects, features and advantages of the invention will be apparent from the following description when read with reference to the accompanying drawings. In the drawings, wherein like reference numerals denote corresponding parts throughout the several views.

Figures 1, 3:
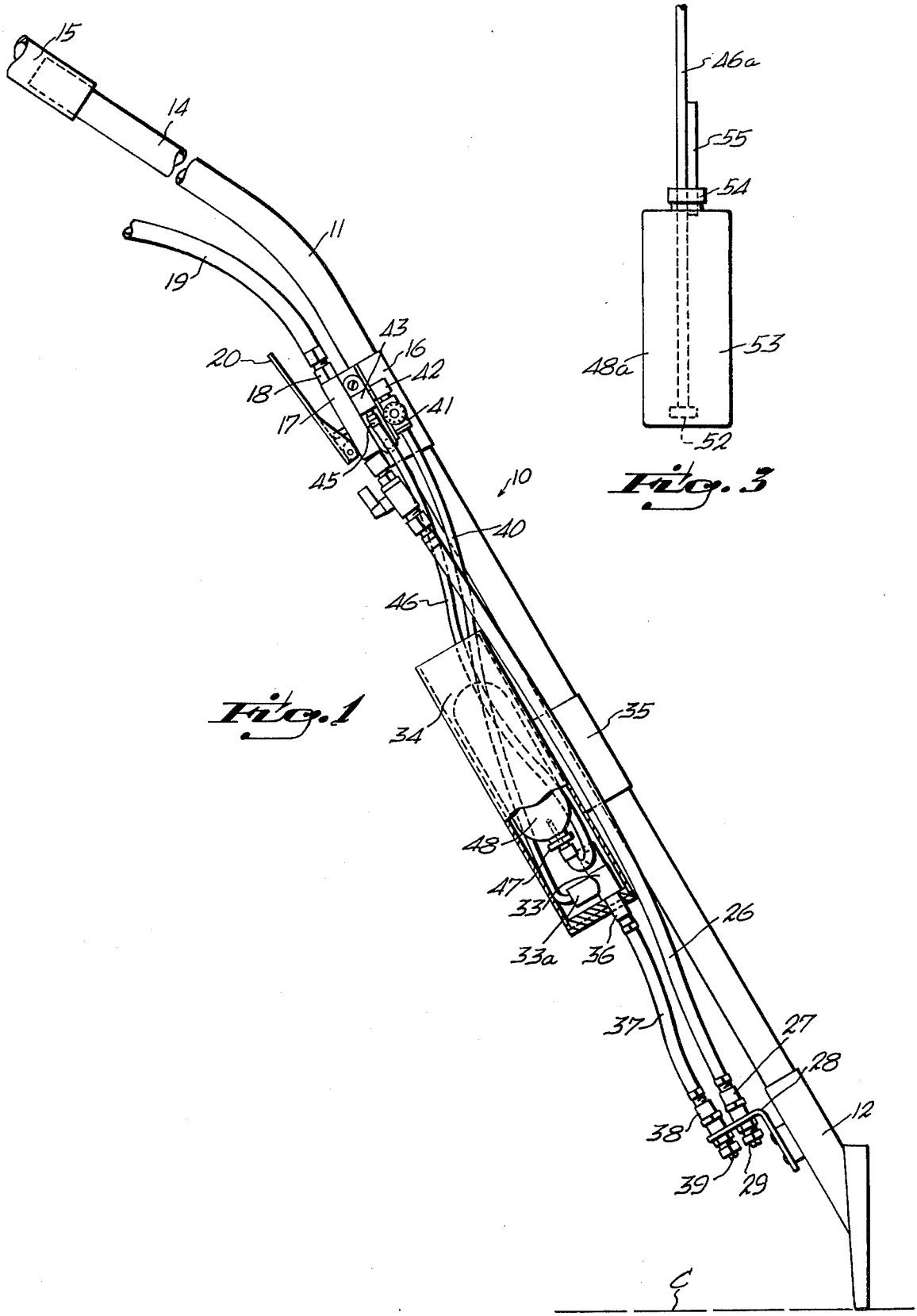
FIG. 1 is a side elevational view of a combination carpet cleaning and dyeing apparatus embodying the invention, with portions broken away to illustrate mechanical details.
FIG. 3 is an elevational view of a modified form of liquid dye container usable with the apparatus of FIGS. 1 and 2.
Figure 2:
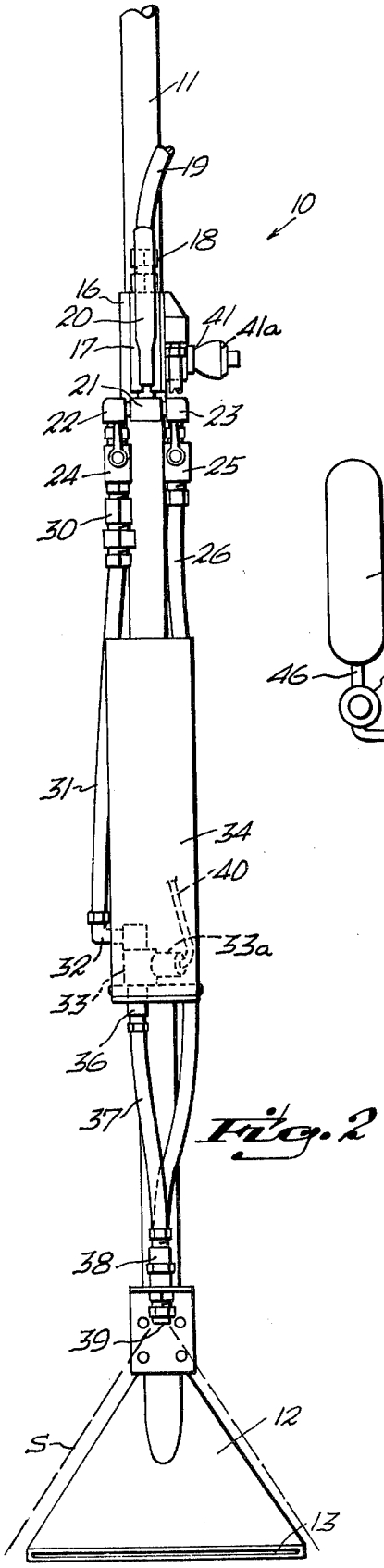
FIG. 2 is a rear elevational view of the apparatus, as viewed in upright position.
Figure 4:
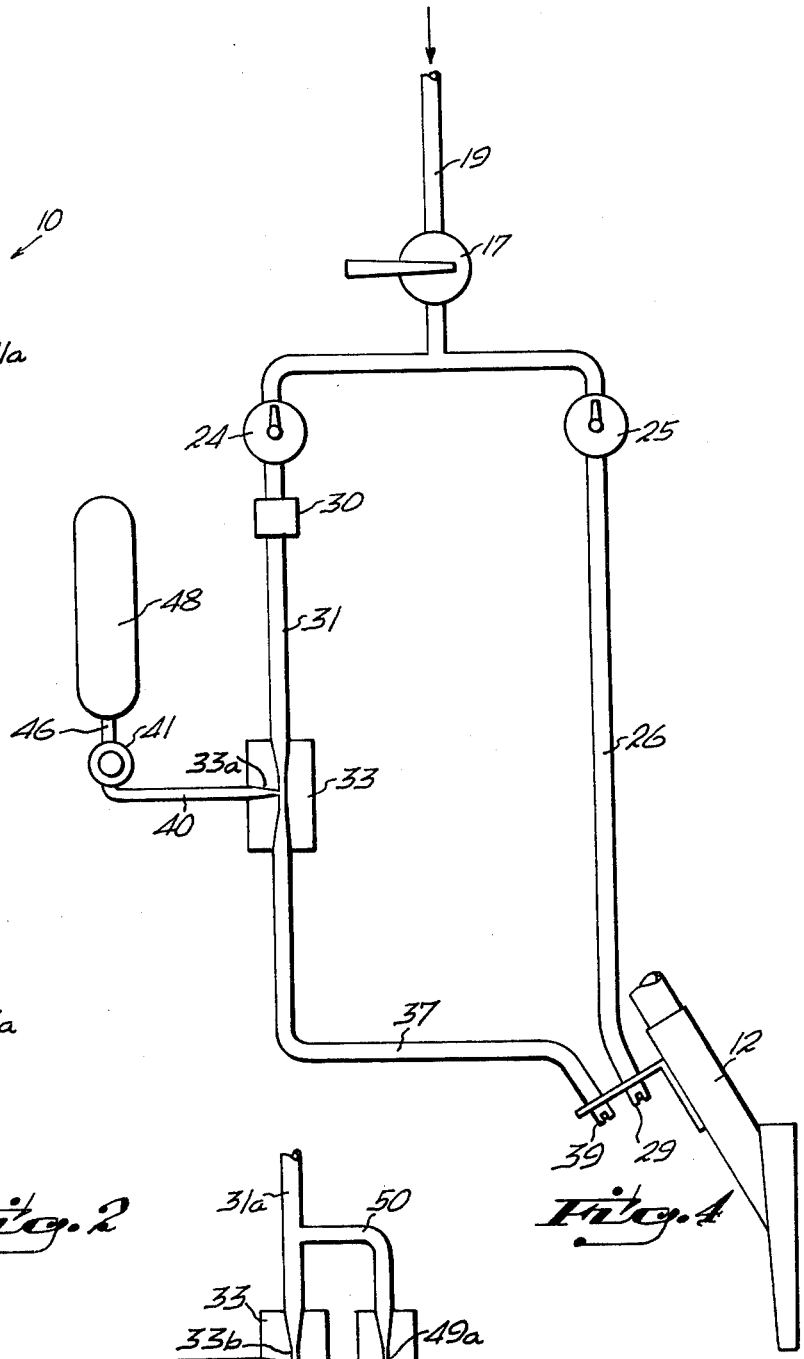
FIG. 4 is a schematic diagram illustrating the flow system and flow adjustment and selection valves for control of carpet cleaning and dyeing operations.

Referring now to FIGS. 1 and 2 of the drawing, reference numeral 10 designates, generally, a preferred form of carpet cleaning and dyeing apparatus embodying the invention, the same comprising an elongated tubular handle and support member 11, the lower end of which is fixed to and communicates with the interior of a hollow, flared vacuum head 12 terminating in a narrow, horizontally-extending, elongated opening 13. The upper end of the tubular handle and support member 11 is curved, as indicated at 14 in FIG. 1 for use as a handle in pushing the apparatus back and forth along carpeting C when in use, as is hereinafter more particularly described. In use, the upper end of the tubular handle portion 15 is adapted to be interconnected, by telescoping friction fit, with a flexible vacuum hose 15 (partially illustrated in FIG. 1) leading from a portable source of vacuum or air suction, in a known manner. A bracket 16 attached to the tubular handle and support member 11 slightly below the curved upper end portion 14 thereof has secured thereto, at the inside, a manually-controllable, pressurized water flow valve 17. A valve inlet fitting 18 at the upper end of valve 17 connects with a pressurized water hose 19 (partially illustrated in FIGS. 1 and 2) leading to a source of pressurized water or water solution for use in cleaning or dye dilution as is hereinbelow described. The pressurized water control valve 17 has a lever 20 convenient for manual manipulation in controlling the flow of pressurized water into a T-fitting 21 fitted in the lower end of said valve. The T-fitting 21 connects at each side with a pair of right-angular fittings 22, 23 (see FIG. 2) which, in turn, connect with individual fluid flow control valves 24, 25, respectively. The outlet port of control valve 25 has attached thereto a flexible fluid hose 26 the lower distal end of which is attached to connector fitting 27 mounted in a right-angular bracket 28 fixed to flared vacuum head 12. The connector fitting 27 terminates in a spray nozzle 29, the spraying orifice of which is of such elongated shape as to produce a fan-shaped dispersion of the fluid being dispensed, directly behind the flared vacuum head 12 as indicated at S in FIG. 2.

The fluid flow control valve 24 has its outlet port connected, through filter member 30, with flexible hose 31, the lower distal end of which connects in communication with elbow fitting 32. The elbow or right-angular fitting 32 communicates with the inlet port of a venturi mixing unit 33 fitted within the lower end of an open-topped, cylindrical housing member 34 supported along the length of the tubular handle and support member 11 as by bracket 35. The outlet port fitting 36 of the venturi mixing unit 33 extends through the bottom of the cylindrical housing member 34 and connects with flexible hose 37. The lower, distal end of the hose 37 communicates with connector fitting 38, also supported by bracket 28, and located directly behind connector fitting 37. The connector fitting 48 terminates in a spray nozzle 39, which may be identical with spray nozzle 29, for producing a laterally-extending, fan-shaped spray of the fluid being dispensed directly behind the flared vacuum head 12.

Means is provided to mix liquid dye with water under pressure being supplied through the venturi mixing unit 33 to spray nozzle 39. To this end, the venturi port 33*a* of venturi mixing unit 33 communicates with flexible conduit 40 extending upwardly through cylindrical housing member 34 and communicating at its upper end with the oulet port of metering valve 41 through a rightangular fitting 42 communicating with support block 43 attached to bracket 16 as by machine screw 34. The support block 43 also has an outlet port attached to which is a downwardly-extending fitting 45 communicating with the internal passageway thereof and a flexible hose or tubing 46. The lower or distal end of the flexible tubing 46 terminates in a hollow needle fitting 47 adapted to piercingly penetrate a plastic concentrated dye container 48 receivable within the open-ended cylindrical housing member 34.

In ordinary use of the apparatus for carpet cleaning, the flexible vacuum hose 15, (partially illustrated in FIG. 1), will be connected with a vacuum unit, preferably portable, as is known in the art, for producing suction at the elongated opening 13 in the flared vacuum head 12. The water hose 19 will be connected to a supply of water solution under pressure, preferably a separate water pressurizing unit, not illustrated. Since auxiliary vacuum producing and pressurized water or water solution devices are commonly known and form no part of the claimed invention, they are not further described herein.

For simple carpet cleaning, the fluid flow control valve 24 is shut completely off so that pressurized water or water and detergent solution, for example, controlled by manual control lever 20, will flow only through hose 26 and spray nozzle 29. In such operation, the fluid flow control valve 25 will be adjusted for the maximum desired spray pressure, which is otherwise controlled for lesser pressure by manual control lever 20. As illustrated in FIG. 2, a fan-shaped pattern of water or water solution spray S is thus discharged behind the flared vacuum head 12 for uniformly wetting the carpet just prior to suction removal of this moisture together with carpet dust and dirt as the apparatus is drawn backwardly along the carpet C as illustrated in FIGS. 1 and 2.

In use of the apparatus for carpet dyeing, (or tinting), the carpet will first be cleaned as described above, after which fluid flow control valve 25 will be closed and valve 24 will be opened to permit pressurized water to flow through the inlet and outlet ports of venturi mixing unit 33 to the spray nozzle 39. Since the venturi port 33*a* of ventui mixing unit 33 connects through flexible tubing 40, metering valve 41 and flexible tubing 46 with the interior of plastic dye container 48, a certain amount of the dye will be sucked in through the venturi port to mix with the water passing through the venturi mixing unit 33, as described above. The proportionate amount of dye being mixed is controlled by adjustment of manual adjustment knob 41*a*. In this manner, the intensity of the dye in the sprayed water can be controlled to produce the desired color effect in the rug or carpet being treated; i.e. either to tint for enhancing color, or to change color by dyeing. Water pressure control lever 17, as well as maximum pressure setting valve 24, provide for uniform proportioning of the dye mix and its volume of discharge at spray nozzle 39, as required, to effect uniform color dyeing or tinting of the rug or carpet. It will be understood that because the plastic dye container 48 is flexible, it will readily collapse as the dye is withdrawn through hollow needle fitting 47, so that no venting is required. Replacement of the dye container 48 is readily accomplished simply by withdrawing it from the cylindrical housing member 34, and removing hollow needle fitting 47, after which a new plastic dye container can be punctured for replacement within the housing member 34.

FIG. 3 illustrates a modification of the invention wherein a substantially rigid cylindrical dye container 53 is used instead of the collapsible dye container 48 described above. The modified container 53 is reusable, and has a screw-on cap 54 at its upper end which supports a short, upwardly-extending vent tube 55. Also passing through the cap 54 is flexible tube 46*a* which terminates in a filter element 52. As illustrated in FIG. 3, when the container cap assemblage 54, 55 and 46*a* is fitted on the dye container 53, the filter element 52 extends just short of the bottom of the container. In this embodiment of the invention the length of flexible tubing 46*a* replaces the tubing 46 leading from fitting 45 as illustrated in FIGS. 1 and 2.

Figure 5:
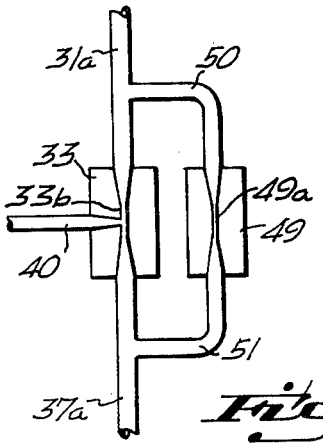
FIG. 5 is a partial schematic diagram illustrating a modification of the dye injection venturi mechanism.

FIG. 5 illustrates a modification of the invention which serves to smoothen any fluid pressure pulsations caused by operation of the remote pumping mechanism supplying fluid to pressurized hose 19. As illustrated, a pressure reducing member 49 is connected in series with conduits 50 and 51, bypassing the inlet and outlet ports of venturi mixing unit 33. The cross-sectional area at the flow reduction zone 49*a* of pressure reducing member 49 is less than that of the restrictive flow portion 33*b* of the venturi mixing unit 33, whereby any pressure surges or pulsations caused by pump operation will be smoothened in outlet hose 37*a* leading to dyeing or color tinting spray nozzle 39 for uniform spraying.

While there are illustrated and described herein only three forms in which the invention can conveniently be embodied in practice, it is to be understood that these forms are given by way of example only and not in a limiting sense. The invention, in brief, comprises all the embodiments and modifications coming within the scope and spirit of the following claims.

What is claimed is:

1. Carpet cleaning and dyeing apparatus comprising, in combination, an elongated tubular handle and support member, a hollow, flared vacuum head member fixed with respect to and communicating with the interior of one end of said tubular handle and support member, said vacuum head member terminating in a narrow, elongated opening extending substantially perpendicularly with respect to longitudinal axis of said elongated tubular handle and support member, first and second spray nozzles secured with respect to said vacuum head member and having elongated spray orifices adapted to spray fluid in fan-shaped configuration and in laterally spaced relation with respect to said flared vacuum head member elongated opening, means for supplying pressurized fluid, selectively, to one of said spray nozzles for carpet cleaning, means for supplying pressurized carpet dyeing solution, selectively, to the other of said spray nozzles, valve means supported on said elongated tubular handle and support member for manual control of pressurized fluid selectively supplied to said spray nozzles, said means for supplying pressurized fluid to said one of saidspray nozzles comprising a first conduit means communicating between said valve means and said one of said spray nozzles, said means for supplying pressurized carpet dye solution to said other of said spray nozzles comprising a second conduit means communicating between said valve means and said other of said spray nozzles, a dye container, a housing member supported on said tubular handle and support member, said dye container being receivable in said housing member, flexible conduit means communicating between said dye container and said second conduit means, and a venturi opening member at the juncture of said flexible conduit means with said second conduit means for withdrawing dye from said dye container into the fluid flow path of said second conduit means.

2. Carpet cleaning and dyeing apparatus as defined in claim 1, wherein said dye container is fabricated of a flexible plastic material so as to collapse as fluid dye is withdrawn therefrom.

3. Carpet cleaning and dyeing apparatus as defined in claim 2, wherein said flexible conduit means communicating said dye container and said second conduit means comprises a hollow needle removably insertable in said flexible container.

4. Carpet cleaning and dyeing apparatus as defined in claim 1, wherein said dye container is substantially rigid and bottle-shaped, said bottle-shaped container having a screw-on cap, and air vent means in said cap, said flexible conduit means extending through said cap.

5. Carpet cleaning and dyeing apparatus as defined in claim 1, including means for smoothening fluid flow pressure pulsations in said second conduit means.

6. Carpet cleaning and dyeing apparatus as defined in claim 5, wherein said pressure pulsations smoothening means comprises a pressure-reducing member connected in said second conduit means in bypassing relation with respect to the juncture of said flexible conduit means with said second conduit means.

7. Carpet cleaning and dyeing apparatus as defined in claim 1, including an adjustable flow metering valve in said flexible conduit means.

* * * * *